United States Patent [19]

Nakamura et al.

[11] 4,444,695

[45] Apr. 24, 1984

[54] VARIABLE VENTURI CARBURETOR

[75] Inventors: Norihiko Nakamura; Takaaki Ito, both of Mishima, Japan

[73] Assignee: Toyota Jidosha Kogyo Kabushiki Kaisha, Japan

[21] Appl. No.: 357,205

[22] Filed: Mar. 11, 1982

[30] Foreign Application Priority Data

Aug. 27, 1981 [JP] Japan ..... 56-133308

[51] Int. Cl.[3] ..... F02M 9/06

[52] U.S. Cl. ..... 261/44 C; 261/DIG. 55

[58] Field of Search ..... 261/44 C, DIG. 55, 44 B, 261/DIG. 21

[56] References Cited

U.S. PATENT DOCUMENTS

| | | | |
|---|---|---|---|
| 1,371,562 | 3/1921 | Kent | 261/DIG. 21 |
| 1,442,257 | 1/1923 | Dorris | 261/DIG. 55 |
| 3,753,555 | 8/1973 | Lawrence | 261/44 C |
| 3,806,101 | 4/1974 | Dyson | 261/DIG. 55 |
| 4,063,540 | 12/1977 | Pace | 261/DIG. 21 |
| 4,259,266 | 3/1981 | Nakamura | 261/44 C |
| 4,302,405 | 11/1981 | Inoue et al. | 261/44 C |

FOREIGN PATENT DOCUMENTS

| | | | |
|---|---|---|---|
| 119187 | 9/1918 | United Kingdom | 261/44 C |
| 1457503 | 12/1976 | United Kingdom | 261/44 C |

*Primary Examiner*—Tim R. Miles

*Attorney, Agent, or Firm*—Finnegan, Henderson, Farabow, Garrett & Dunner

[57] ABSTRACT

A variable venturi carburetor according to this invention is so arranged that during low load operation with a small degree of opening of the throttle valve, the suction piston is moved forward corresponding to a reduced amount of suctioned air to make a width of the venturi portion narrow and maintain negative pressure in the venturi portion at a constant level, fuel suctioned from the float chamber is gauged in an amount thereof under the cooperation of the metering needle with the metering jet and then ejected from the main nozzle, the ejected fuel strikes upon the head of the suction piston due to inertia thereof and then flows down along the surface of the head, the fuel collecting at the lower surface is received in the fuel receiver and flows down through the path formed in the wall of the barrel into the intake manifold in an atomized state, bypassing the throttle valve.

3 Claims, 5 Drawing Figures

VARIABLE VENTURI CARBURETOR

BACKGROUND OF THE INVENTION

This invention relates to a technique for preventing fuel from dripping out of a suction piston of a variable venturi carburetor during low load operation.

As is well known, various kinds of carburetors have been adopted for automobile engines. Among them a variable venturi carburetor has been generally employed and equipped on automobiles in a wide range from some sport-type models to normal models because of superior transient responsibility and a reduced height of the entire unit.

However, more than a few problems to be improved remain in such variable venturi carburetors.

One of these problems is the fact that fuel periodically drips during low load operation.

As shown in FIG. 1, in a variable venturi carburetor 1, an amount of suctioned air varies in proportion to the degree of opening of a throttle valve 2 and a suction piston 3 opens or closes a venturi portion 4 corresponding to the amount of suctioned air. But, when the suction piston 3 is located at a position near a main nozzle 5 in a low load state, fuel, having been suctioned from a float chamber 6 via a well 7 and gauged in the amount thereof under the cooperation of a metering needle 8 integrally extending forward from the head of the suction piston 3 with a metering jet 9 strikes upon the head of the suction piston due to inertia thereof immediately after being ejected from the main nozzle 5, and only a part of the fuel is atomized and flows down into a mixing chamber 10.

Then, the fuel which struck upon the head of the suction piston 3 and attached thereon flows down along the surface of the head and collects together on the end surface 11 at the downstream side to grow up to a large fuel droplet 12. When the force of gravity acting on the fuel droplet exceeds the surface tension thereof, the fuel droplet drops upon the trottle valve 2 as illustrated in the drawing, thus resulting in an increased air/fuel ratio at each drop.

Furthermore, since the fuel droplets 12 grow periodically in time and hence drip periodically, it exerts a great influence, particularly when an amount of supplied fuel is small, for example, during idling. As shown in FIG. 2, where the abscissa represents time T and the ordinate represents and air/fuel ratio A/F, a disadvantage has been encountered such that the air/fuel ratio becomes rich in the form of a spike synchronous with the dropping of the fuel droplet, thus leading to drawbacks such that the rpm of the engine varies every time the fuel droplet 12 drops, making the idling unstable.

SUMMARY OF THE INVENTION

The first object of this invention is to solve this problem experienced in the conventional variable venturi carburetor of the air/fuel ratio fluctuating due to fuel collecting on the surface of the suction piston during low load operation as explained above. The second object of this invention is to provide an improved variable venturi carburator, supposing it inevitable that fuel ejected from the main nozzle will collect on the head of the suction piston during low load operation, in which a fuel receiver is provided beneath the suction piston in the vicinity thereof and a path bypassing the throttle valve is connected with the fuel receiver so as to supply the collected fuel to the intake manifold, whereby fluctuations in the air/fuel ratio can be eliminated and hence engine rpm becomes stable.

DESCRIPTION OF THE PREFERRED EMBODIMENTS

Figure 3:
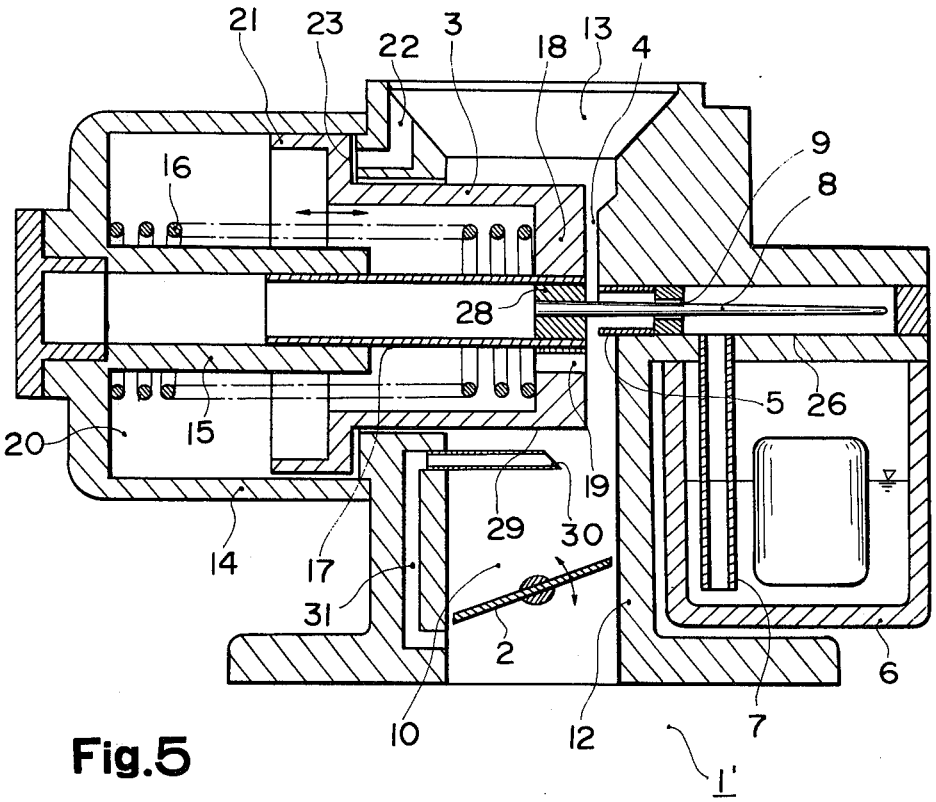
FIG. 3 is a longitudinal cross-sectional view for explaining the first embodiment of this invention.

Preferred embodiments of this invention will be described with reference to FIGS. 3 through 5 as follows.

Figure 1:
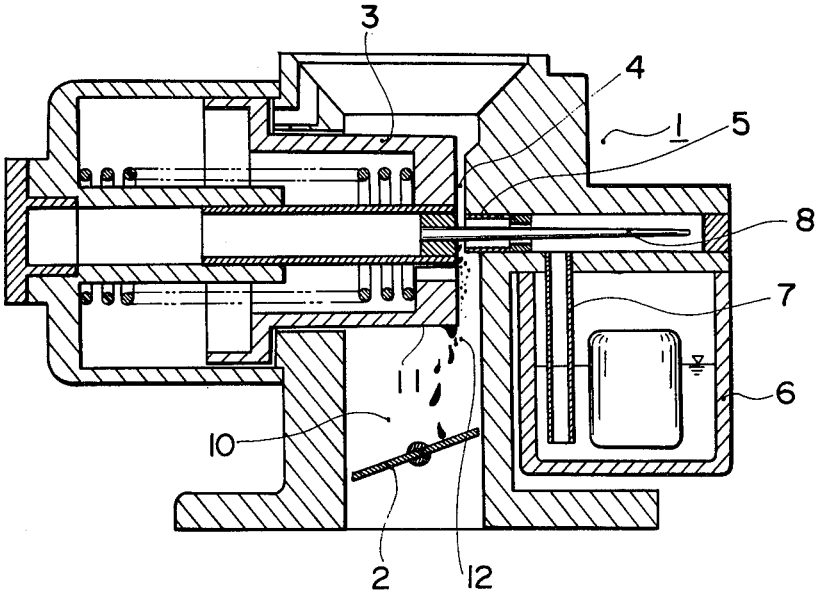
FIG. 1 is a view for explaining dropping of fuel droplets in a variable venturi carburetor according to the prior art.
Figure 2:
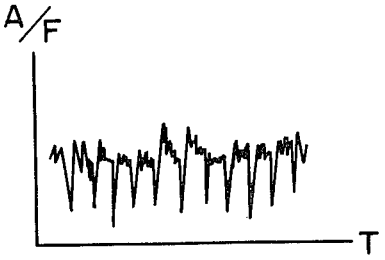
FIG. 2 is a view for explaining fluctuations in time of the air/fuel ratio in the variable venturi carburetor of FIG. 1.

By the way, corresponding parts shown in these drawings are denoted by the same reference numerals in FIG.1 for the following description.

Reference numeral 1' denotes a variable venturi carburetor constituting the essentials of this invention, in which an air horn 13 and a throttle valve 2 are provided at the upstream and downstream side of a barrel 12, respectively, and a suction chamber 14 is disposed at one side of a venturi portion 4 which is formed between the air horn 13 and the throttle valve 2. The suction chamber 14 includes a suction piston 3 slidably fitted therein and a rod 17 is inserted in a rod guide 15 of the suction chamber 14 via a damper spring 16. Negative pressure within a mixing chamber 10 is transmitted to a negative pressure chamber 20 within the suction chamber 14 through a suction hole 19 which is bored in a head 18 of the suction piston 3.

In addition, an atmospheric chamber 23 is formed via a communication path 22 extending from the air horn 13 in a space in front of a flange portion 21 of the suction piston 3.

A float chamber 6 having a float 24 is provided at the other side of the venturi portion 4 and a fuel supply well 7 is connected with a fuel path 26. A metering jet 9 provided in the fuel path 26 is connected with the air horn 13 via an air bleed (not shown) and receives a metering needle 8 fixed to the head 18 of the suction piston 3 via a fixture 28 and extends forward therefrom. The amount of fuel to be suctioned is gauged by the metering needle 8 in cooperation with the metering jet 9, mixed with bleed air from an air bleed 27 and then ejected out of a main nozzle 5.

This structure mentioned above is basically the same as that of the prior variable venturi carburetor.

According to this invention, a pipe 29 with an inner diameter of 0.5–3 mm, for example, serves as a fuel receiver and is provided beneath the suction piston 3 at a position spaced from the lower peripheral surface therefor by 0.5–2 mm, for example. The distal end of the pipe 29 is formed to have an opening 30 inclined at an angle of 45° facing upward. The pipe 29 is so located that its distal end does not protrude from the head of the suction piston in a fully closed state, while the proximal end of the pipe 29 is force fitted to the upper end of a path 31 which is formed by boring a tunnel in the wall of the barrel 12 with the lower end opening at the downstream side of the throttle valve 2.

With this arrangement, when the throttle valve is properly opened or closed in response to conditions of engine operation, negative pressure is produced within the mixing chamber 10 corresponding to a degree of opening of the throttle valve 2, and transmitted to suction chamber 20 through the suction hole 19 so as to form negative pressure therein. To balance the relation between negative pressure, atmospheric pressure within the atmospheric chamber 23 and the pressing force of damper spring 16, the suction piston 3 is moved forward or rearward in response to the amount of suctioned air, so that the venturi portion 4 is correspondingly closed or opened to maintain constant negative pressure in the venturi portion 4. In this connection, fuel within the float chamber 6 is suctioned through the well 7 to the fuel path 26. The amount of fuel suctioned is gauged by the metering needle 8 in cooperation with the metering jet 9, the fuel is mixed with bleed air and then ejected from the main nozzle 5.

As illustrated in the drawing, when the engine is operated under low load such as during idling, the throttle valve 2 is practically closed and the head 18 of the suction piston 3 is located at a position very close to the main nozzle 5.

Therefore, most of the fuel ejected from the main nozzle 5 collects upon the head 18 of the suction piston 3 due to the inertia thereof as mentioned before, and only a part of the ejected fuel flows down atomized in the air stream.

The fuel collecting on the head 18 flows down along the surface and collects at the lower end surface of the head and grows up into a droplet. On this occasion, the grown-up droplet is, before dropping, received by the inclined opening 30 of pipe 29 which is provided adjacent to the lower peripheral surface of the suction piston. Accordingly, the fuel droplet does not drop but flows down through tunnel path 31 into the intake manifold, bypassing the throttle valve 2.

In other words, before the fuel ejected successively grows large enough to drop or drip from the head of the suction piston, it enters the opening of pipe 29, and flows down to the intake manifold in an atomized state.

Figure 4:
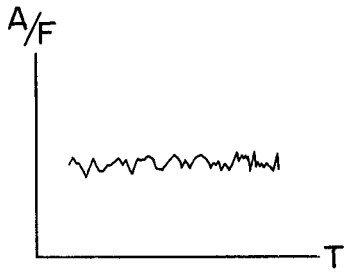
FIG. 4 is a view for explaining the characteristic curve of the air/fuel ratio vs. time.

Consequently, the air/fuel ratio in the intake manifold becomes stable as shown by the experimental data in FIG. 4, so that the rpm of the engine does not fluctuate.

Figure 5:
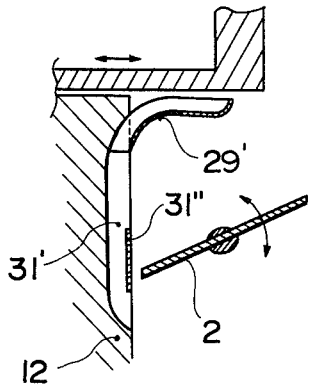
FIG. 5 is a view for explaining another embodiment of this invention, showing a fuel receiver and a path.

In another embodiment as illustrated in FIG. 5, the path formed in the wall of the barrel 12 is a groove-shaped path 31' and a fuel receiver 29' in the form of a trough is connected to the upper end of the path 31' with the distal end of the fuel receiver 29' being upward and the proximal end thereof being downward. A part of the groove-like path 31' is covered with a throttle valve sealing plate 31''. There is no difference in basic operation and effect between this embodiment and the above mentioned embodiment.

By the way, it is a matter of course that the practical use of this invention is not limited to the foregoing embodiments. For example, various other modified embodiments can be adopted such as the pipe serving as the fuel receiver is so located that the inclined opening at the distal end of the pipe extends over a low load region, the fuel receiver is inclined on the whole, and the lower end of the path is divided into a plurality of branches to improve the distribution among cylinders.

As fully described above, in a variable venturi carburetor according to this invention the fuel receiver is provided beneath the suction piston in the vicinity thereof and connected with a path formed in the wall of the barrel in communication with the intake manifold and bypassing the throttle valve. Thus, when the variable venturi carburetor is in low load operation such as idling, even when the suction piston approaches the main nozzle, and fuel ejected from the main nozzle strikes upon the head of the suction piston, flows down the surface of the head and collects at the lower end surface of the head, the collected fuel is received by the fuel receiver provided beneath the suction piston before it can grow to a large droplet, thereby resulting in such advantageous effects that the collected fuel will not periodically drop onto the throttle valve, the air/fuel ratio will not undergo periodic variations and hence the engine rpm will not fluctuate.

Furthermore, the fuel received by the fuel receiver flows down through the path in the wall of the barrel into the intake manifold bypassing the throttle valve, whereby even the fuel collecting on the head of the suction piston can be supplied to the intake manifold, thus leading to such advantageous effects that the air/fuel ratio is not varied and the engine rpm becomes stable.

In addition, the path is formed in the wall of the barrel at the side of the throttle valve in such a manner that the presence of the path does not interfere with the throttle valve, and the fuel receiver is connected to the upper end of the path, thereby having advantages in that the failure rate can be reduced because of the simplified structure and the absence of mechanical operating parts, labor necessary for maintenance is reduced, manufacturing cost is lowered and also assembly is faciliated.

What is claimed is:

1. In a variable venturi carburetor wherein a suction chamber is disposed side by side with a venturi portion formed between an air horn at the upstream side of a barrel and a throttle valve at the downstream side of said barrel, and a suction piston is slidably received in said suction chamber to open or close said venturi portion, said piston having an extended metering needle movable forward or rearward with respect to a metering jet, the improvement comprising a fuel receiving trough extending into a mixing chamber between said suction piston and said throttle valve, said fuel receiving trough being open toward the lower surface of said suction piston along the path of movement of said piston and being disposed to receive unatomized fuel and to conduct said fuel through a path extending along the inner wall of said barrel to an opening at a position downstream of said throttle valve.

2. A variable venturi carburetor according to claim 1, wherein said fuel receiving trough extends across said mixing chamber a distance less than the leading end of said suction piston in a fully closed state.

3. A variable venturi carburetor according to claim 2 wherein the path formed in the wall of said barrel is in the form of a groove.

* * * * *